United States Patent [19]

Solomon

[11] 4,145,232

[45] Mar. 20, 1979

[54] PROCESS FOR CARBURIZING STEEL

[75] Inventor: Jack Solomon, Rye, N.Y.

[73] Assignee: Union Carbide Corporation, New York, N.Y.

[21] Appl. No.: 803,202

[22] Filed: Jun. 3, 1977

[51] Int. Cl.[2] ..... C21D 1/56

[52] U.S. Cl. ..... 148/16.5; 148/20.3

[58] Field of Search ..... 148/16, 16.5, 20.3; 266/257, 251

[56] References Cited

U.S. PATENT DOCUMENTS

| | | | |
|---|---|---|---|
| 1,961,766 | 6/1934 | Jennings | 266/251 |
| 2,886,478 | 5/1959 | Beard | 148/16.5 |
| 3,201,290 | 8/1965 | Wyss | 148/16 |
| 3,356,541 | 12/1967 | Cullen | 148/16.5 |
| 3,397,875 | 8/1968 | Davis | 148/16.5 |
| 3,413,161 | 11/1968 | Goehring | 148/16.5 |
| 3,693,409 | 9/1972 | Yamagishi | 148/16.5 |
| 3,950,192 | 4/1976 | Golland et al. | 148/16.5 |
| 4,049,472 | 9/1977 | Arndt | 148/16.5 |
| 4,049,473 | 9/1977 | Davis et al. | 148/16.5 |

*Primary Examiner*—L. Dewayne Rutledge
*Assistant Examiner*—John P. Sheehan
*Attorney, Agent, or Firm*—Saul R. Bresch

[57] ABSTRACT

In a process for carburizing steel in a furnace, using a defined carburizing atmosphere and regulating in defined manner the hydrocarbon component according to the amount of carbon dioxide present; maintaining a high flow rate when the passage through which the steel passes is open and a low flow rate when it is closed; and closing all other passages through which gas can pass.

11 Claims, No Drawings

PROCESS FOR CARBURIZING STEEL

FIELD OF THE INVENTION

This invention relates to a process for the gas carburizing of steel and, more particularly, to such a process wherein atmosphere control is optimized.

DESCRIPTION OF THE PRIOR ART

Carburizing is the conventional mode for case hardening low carbon steel. In gas carburizing, the steel is exposed to a rapidly flowing carburizing atmosphere for a predetermined period of time until the desired amount of carbon is introduced into the surface of the steel to a predetermined depth called the depth of the case. The case has good wear properties because of its extreme hardness while the inner portion of the steel, i.e., that portion beyond the case depth, referred to as the core, remains relatively soft and ductile and has good toughness qualities. Case hardened steels are utilized in gears, camshafts, shells, cylinders, and pins, for example, where the combination of a wear resistant surface with a tough core are so important. Carburizing, and particularly gas carburizing, carbonitriding, and a more extensive list of various steel parts subjected to carburizing are described in the "Metals Handbook", edited by T. Lyman, published by the American Society for Metals, Novelty, Ohio, 1948, pages 677 to 697. Carburizing and box and pit furnaces in which the carburizing process is carried out are described in "The Making, Shaping and Treating of Steel, 8th edition, 1964, pages 1058 to 1068. Carburizing furnaces are also described in the same "Metals Handbook" referred to above in an article "Electrically Heated Industrial Furnaces", by Cherry et al, pages 273 to 278, particularly FIGS. 1, 2, and 8, the latter being an example of a pusher furnace, which is commonly used for carburizing in a continuous manner, as an alternative to batch processing.

It has long been recognized that the carburizing atmosphere must be controlled in order to provide the desired amount of carbon at the desired case depth and, further, to substantially avoid decarburization and oxidation of the workpiece. The excessive and wasteful use of the gases that are used to provide the carburizing atmosphere has also been acknowledged. To this end, it has been suggested that the carburizing atmosphere be enriched, cleaned using filtering and purges, and recirculated at high flow rates. It was found, however, that these suggestions complicated the carburizing process. The practical solution provided by the industrial carburizers was to use a high and constant flow rate of endo gas (the carrier gas most commonly used to provide the carburizing atmosphere) throughout the carburizing process, which although wasteful of natural gas, was simple and insured an adequate carburizing atmosphere. Unfortunately, gases (including vaporized liquids), e.g., natural gas, methane, and propane, sources of the endo gas used to provide the carburizing atmosphere, are in short supply especially during the cold months and/or are relatively expensive. It has, therefore become desirable to eliminate the excessive use of these gases without sacrificing process simplicity or atmosphere control.

SUMMARY OF THE INVENTION

An object of this invention, then, is to provide an improvement in a known carburizing process whereby the amount of the gases needed to provide the carburizing atmosphere is considerably reduced while simplicity of process and an adequate carburizing atmosphere is maintained.

Other objects and advantages will become apparent hereinafter.

According to the present invention, an improvement in a known carburizing process has been discovered which meets the aforementioned objective. The known process is one for carburizing steel to provide or maintain a surface carbon concentration of at least about 0.4 percent based on the weight of the steel. The process is carried out in a furnace having at least one carburizing chamber, said chamber being closed except for at least one passage through which the steel passes into and out of the chamber and having means for opening and closing the passage, and comprises opening the passage, introducing steel through the passage into the chamber, closing the passage, exposing the steel to a carburizing atmosphere at a temperature in the range of about 1200° F. to about 2200° F. until the steel is carburized, opening the passage, withdrawing the steel through the passage, and closing the passage.

The improvement in this known process comprises: introducing a carrier gas and a gaseous hydrocarbon into the chamber, said carrier gas and hydrocarbon being such that they will provide the carburizing atmosphere comprising, in percent by volume based on the total volume of the carburizing atmosphere in the chamber:

| component of atmosphere | percent by volume |
|---|---|
| carbon monoxide | about 4 to about 30 |
| hydrogen | about 10 to about 60 |
| nitrogen | about 10 to about 85 |
| carbon dioxide | 0 to about 4 |
| water vapor | 0 to about 5 |
| hydrocarbon | about 1 to about 10 |

said hydrocarbon being present in sufficient amount to maintain $Z_A$ at a level about equal to $(K_A/100)(X^2/Yg)$ wherein:

$Z_A$ is the percent by volume of carbon dioxide;

X is the percent by volume of carbon monoxide;

$K_A$ is the equilibrium constant for the reaction $2\,CO \rightleftarrows C + CO_2$;

Y is the predetermined percent by weight of carbon on the surface of the steel based on the weight of the steel; and g is the activity coefficient for carbon dissolved in the steel; and said carrier gas being at a low flow rate at the time when the passage is closed and at a high flow rate at the time when the passage is open, (i) the minimum low flow rate being sufficient to limit the oxygen species entering the atmosphere whereby an amount of no greater than about 10 percent hydrocarbon will be required to maintain the value of $Z_A$ as set forth above;

(ii) the maximum low flow rate being no greater than about one half of the minimum high flow rate; and (iii) the minimum high flow rate being sufficient to essentially prevent the oxidation and decarburizing of the steel.

DESCRIPTION OF THE PREFERRED EMBODIMENT

While subject process has been referred to as a carburizing process, it will be understood by those skilled in the art that the term "carburizing" as used herein with respect to the defined process includes any process for the heat treatment of steel wherein the carbon in the steel is controlled by the use of a hydrocarbon, e.g., carburizing, carbonitriding, bright hardening (where the initial carbon content is merely maintained), carbon restoration, and other processes of a similar nature, and the same advantages will be obtained. Where the process is carburizing, carbonitriding, or carbon restoration, carbon is added. Where the process is bright hardening, the steel has an initial carbon content, which is maintained throughout the process. The carbon is supplied via the equations (A), (B), and (C), set out below.

The furnaces used in subject process are usually of conventional construction. Box, pit, and pusher type furnaces have been referred to above, but many variations exist. These furnaces generally have heating and cooling means; one or more carburizing chambers in which the workpieces are placed on a hearth of platform, or suspended, and exposed to heat and carburizing atmosphere; and one or more doors through which the steel passes into or out of the chamber. In addition to the foregoing, there are usually vents to avoid pressure build-up; vestibules between the doors to the chamber and the outer doors to the furnace; and circulating fans to expedite gas phase mass transfer and heat transfer. The pusher type (continuous) furnace differs only in that it has a series of chambers and doors through which the workpieces are pushed from one end of the furnace to the other. One important difference between batch furnaces and continuous furnaces is that in batch furnaces carburizing does not begin until the furnace reaches the carburizing temperature, which is typically about 30 minutes after the doors are closed, and there is no door opening until the end of the carburization cycle, which may be about 3 to 9 hours thereafter. On the other hand, in the continuous furnaces, doors are opened and closed frequently, typically about every hour.

The carburizing chambers of the furnaces of interest here are "closed", which means that vents or any other openings through which gases can pass into or out of the chamber are closed and kept closed throughout the process except, of course, for the passages, doors or other openings, through which the steel workpieces pass into or out of the chamber; gas inlet ports necessary to provide the carburizing atmosphere; and sample ports commonly used for testing purposes. The objective of the "closed" chamber is to keep the influx of oxidizing gases to a minimum and limit losses of carburizing atmosphere. It will be understood by those skilled in the art, however, that some leakage can be tolerated at a sacrifice to optimum performance. Although not conventional, the "closed" chamber would include chambers which are built without vents or other openings other than the passages for workpieces, required gas inlet ports, and sample ports. Even with doors or other passages closed, it will be recognized that there will be some passage of gases through the door seals or other seals since any seals are vulnerable to the passage of gases. It is found that the use of the closed chamber and conventional door seals together with the low flow rate of the process is adequate to prevent substantial air infiltration and minimize atmosphere leakage when the doors are closed, the outflowing atmosphere and the incoming air mutually blocking one another.

Door opening and closing and introduction of the steel workpieces or load may be accomplished manually or automatically, but is, again, conventional as is the internal temperature of the chamber where the carburizing takes place. This temperature lies within a range of about 1200° F. to about 2200° F. and is preferably about 1500° F. to about 1850° F.

Carburizing time is about 1 to about 50 hours and is typically about 3 to about 9 hours. Particular times, however, are selected according to the depth of case desired and experience with various workpieces, carbon concentrations, and atmospheres.

The carburizing atmosphere is usually provided by introducing endo gas, dried endo gas, or nitrogen and methanol (or ethanol) into the carburizing chamber. The atmosphere may be provided by introducing each of its components in the desired proportions, but this is only practical on a laboratory scale. Industrially, the endo gas is prepared in a gas generator by the reaction of air with natural gas (or propane). These gas or endo generator (s) operate independently from the furnace, and are most reliable when their output flow rate is essentially constant. Wide variations in output to accommodate the introduction of additional gas to the furnace when the passages are open limits the dependability of the endo generator. The reaction of air and natural gas yields a mixture of primarily carbon monoxide, hydrogen, and nitrogen, and this mixture is referred to as endo gas.

A typical endo gas composition where the endo gas is made from natural gas is about 20 to 23 percent carbon monoxide; about 30 to 40 percent hydrogen; about 40 to 47 percent nitrogen; about 0 to 1 percent water vapor; and about 0 to 0.5 percent carbon dioxide. The composition of the endo gas varies with the composition of the natural gas used to provide it. The endo gas may be given a purification treatment to remove moisture and carbon dioxide.

Endo gas is one source for the carburizing atmosphere. Another source is nitrogen and methanol. These sources and others used to provide the carburizing atmosphere are commonly referred to as the "carrier gas" and this term will be used in this specification. The term "carrier gas", therefore, includes any gases and/or liquids (which vaporize and decompose at furnace temperatures) and mixtures thereof used to provide the atmosphere in the carburizing chamber. Two sources have been mentioned: endo gas and the nitrogen-methanol combination. It should be noted that nitrogen and methanol are generally introduced into the chamber separately although usually simultaneously. Ethanol can be substituted for the methanol with similar results. Carbon monoxide, hydrogen, and nitrogen can also be introduced into the chamber in appropriate amounts, again separately but usually simultaneously. Water is not intentionally introduced, but, in vapor form, may get into the chamber together with the endo gas or together with air, which infiltrates into the chamber despite precautions. It will also be seen that water is a product of a reaction taking place in the chamber. Carbon dioxide enters the chamber in a fashion similar to water. The use of dried or purified endo gas or nitrogen-methanol as the carrier gas provides a means for essentially restricting the introduction of carbon dioxide and water vapor from outside of the system. Since methanol is usually provided commercially in a purified state, the purification treatment sometimes given to endo gas is not generally given to methanol.

The components of the atmosphere in the chamber and their percentages in percent by volume based on the total volume of the atmosphere in the chamber are as follows:

| Component of atmosphere | percent by volume maximum range | preferred range |
|---|---|---|
| carbon monoxide | about 4 to about 30 | about 18 to about 23 |
| hydrogen | about 10 to about 60 | about 27 to about 45 |
| nitrogen | about 10 to about 85 | about 34 to about 47 |
| carbon dioxide | 0 to about 4 | 0 to about 1 |
| water vapor | 0 to about 5 | 0 to about 2 |
| hydrocarbon | about 1 to about 10 | about 1 to about 8 |

The endo gas supplies carbon monoxide, hydrogen, and nitrogen while the methanol supplies carbon monoxide and hydrogen. The carbon monoxide and hydrogen react to provide carbon and water and the carbon monoxide itself yields carbon and carbon dioxide. The hydrocarbon decomposes to provide carbon and hydrogen.

The equations are as follows:

(A) $2CO \rightleftarrows C + CO_2$ (B) $CO + H_2 \rightleftarrows C + H_2O$

Using methane as an example of a hydrocarbon:

(C) $CH_4 \rightarrow C + 2H_2$

It is apparent that the atmosphere must be in a reducing state at all times to avoid metal oxidation by air, water, or carbon dioxide.

The hydrocarbon can be any hydrocarbon which will decompose into carbon and hydrogen in the temperature range referred to above. This includes hydrocarbons consisting of carbon and hydrogen atoms including aliphatic, cycloaliphatic, both saturated and unsaturated, and aromatic hydrocarbons. Preferred are the $C_1$ to $C_5$ hydrocarbons, methane being more commonly used, and natural gas is generally used to provide the methane component. Propane is also used in some cases as well as butanes and pentanes. The hydrocarbon component is often referred to as the enriching gas. The term "gaseous hydrocarbon" is used herein to include hydrocarbons which are gases or liquids (which vaporize at furnace temperatures) and mixtures thereof.

The quantity of gaseous hydrocarbon is controlled by providing a sufficient amount to maintain $Z_A$ at a level about equal to $(K_A/100)$ $(X^2/Yg)$ wherein:

$Z_A$ is the percent by volume of carbon dioxide;

X is the percent by volume of carbon monoxide;

$K_A$ is the equilibrium constant for the reaction $2CO \rightleftarrows C + CO_2$;

Y is a predetermined percent by weight of carbon on the surface of the steel based on the weight of the steel (and is equal to the percent by weight of carbon desired to the depth of case); and g is the activity coefficient for carbon dissolved in steel.

It will be readily apparent to those skilled in the art that maintaining the proper level of hydrocarbon will also keep $Z_B$ about equal to $(K_B/100)$ $(XQ/Yg)$ wherein $Z_B$ is now the percent by volume of water vapor; X, Y, and g are the same as above; $K_B$ is the equilibrium constant for the reaction $CO + H_2 \rightleftarrows C + H_2O$; and Q is the percent by volume of hydrogen. Thus, maintaining $Z_B$ in terms of water vapor will inherently cause the maintenance of $Z_A$ in terms of carbon dioxide and vice versa.

It will also be readily apparent that maintaining the proper level of hydrocarbon will also keep $Z_D$ about equal to $(K_D/100)$ $(X/Yg)$ wherein $Z_D$ is now the square root of the oxygen concentration, X, Y, and g are the same as above; and $K_D$ is the equilibrium constant for the reaction $CO \rightleftarrows C + \frac{1}{2} O_2$. Thus, maintaining $Z_D$ in terms of the square root of the oxygen concentration will inherently cause the maintenance of $Z_A$ in terms of carbon dioxide and vice versa.

In the above equations, the term "about" is used to denote that, in practice, due to the different characteristics of furnaces, atmosphere sampling, or other operating parameters, equality is not always achieved. A correction factor represented by the term "about" is considered to be between 0.5 and 1.5.

Since the rate of diffusion of carbon into the steel is proportional to the carbon gradient in the steel, it is preferred that the level of carbon input is high at the beginning of the carburizing cycle and lower as carburizing progresses. When the surface carbon concentration exceeds the solubility of the carbon in the steel, soot (carbon) will form on the surface. Maintaining the hydrocarbon at the level where $Z_A$ is about equal to $(K_A/100)$ $(X^2/Yg)$ avoids this problem provided that Y is below the solubility level of carbon in the steel.

In order to maintain $Z_A$ at the indicated level, the amount of hydrocarbon is raised or lowered. In addition to the reaction in equation (C) above, the hydrocarbon reacts according to the following equations presented in terms of methane:

(D) $CH_4 + CO_2 \rightarrow 2\ CO + 2H_2$ (E) $CH_4 + H_2O \rightarrow CO + 3H_2$ Oxygen species in the form of water, carbon dioxide, air, and oxides enter the heat treating chamber continually from a variety of sources, some noted heretofore: air infiltration; carbon dioxide and water in the endo gas; reactions at the surface of the steel; and water and oxide carried in with the workpieces. The concentrations of oxygen species in the furnace atmosphere are controlled by adjusting hydrocarbon input and the flow rate of carrier gas.

It should be pointed out that no more than about one percent by weight of the carbon entering the carburizing chamber is used to carburize the steel. Therefore, substantially lowering the flow rate will not limit the amount of carbon available for carburizing.

Low flow rates are imposed at the time when the passages through which the workpieces or load passes are closed and high flow rates are in effect at the time when the passages are open. It is preferred that the period of high flow continue for a short time after the passages are closed to insure maintenance of the desired carburizing atmosphere, which is subject to process upset when the passages are open and shortly thereafter due to the severe pressure drop. The high flow rate controls the process upset.

As noted, the minimum low flow rate is sufficient to limit the oxygen species entering the atmosphere in the chamber whereby an amount of no greater than about 10 percent hydrocarbon and preferably no greater than about 8 percent hydrocarbon is required to maintain the value of $Z_A$ referred to above. The limitation on the amount of hydrocarbon insures the absence of soot formation in the defined process. Such a minimum flow rate maintains the carburizing atmosphere at an adequate level and blocks air infiltration. The use of a dried endo gas will lower the minimum flow rate further. The nitrogen-methanol mixture having a low water and carbon dioxide content is advantageous is this respect also.

The maximum low flow rate is no greater than about one half of the minimum high flow rate and is designed to avoid waste of the carrier gas and, to this end, it is preferred that the maximum low flow rate be no greater than about one quarter of the minimum high flow rate.

The minimum high flow rate is sufficient to essentially prevent the oxidation and decarburizing of the steel, and can be determined by reducing the flow in stages until metal samples show decarburization or oxidation. The minimum high flow rate is further determined by analyzing the metal samples to see whether the steel is being carburized at the proper rate. Analysis of metal samples is accomplished by conventional means. Visual checks may be made by observation of blueing (surface oxidation) or sooting (carbon deposition).

In order to keep gas usage to a minimum, it is most preferred to use the minimum low flow rate and the minimum high flow rate. There is no advantage in going above the minumum except to insure that some upset does not inadvertently cause the flow to drop below the minimum. No maximum high flow rate has been indicated since the upper limit is merely one of practicality. Again, it is preferred to use the lowest high flow rate feasible.

The carrier gas used during both low flow and high flow can be endo gas, but, in order to keep the endo gas generators at a constant output, which is effective in maintaining their reliability, it is preferred that the difference between the low flow rate and the high flow rate be made up by using a different carrier gas, e.g., nitrogen-methanol or nitrogen-natural gas. The use of a carrier gas, other than endo gas, to make up the balance between low flow and high flow provides an atmosphere source whose flow rate is easily and rapidly varied in order to maintain the ratios of water to hydrogen and carbon dioxide to carbon monoxide such that the atmosphere is always reducing. Where surface carbon control is critical throughout as in continuous processes, it is found that nitrogen-methanol is a more satisfactory choice. In the batch furnace, where carbon control is not as critical during the initial portion of the cycle, either nitrogen-methanol or nitrogen-natural gas can be used effectively since the high concentration of methane from the natural gas source will be flushed out by the low flow and the carbon monoxide concentration will rise until it is supplying most of the carbon. In some batch furnaces, nitrogen alone can be used to supply the additional flow as long as the atmosphere in the carburizing chamber returns to the desired composition before the load reaches the carburizing temperature.

The means for varying the flow rate on door opening (the transition from low flow to high flow) are conventional, e.g., by the use of solenoids or other automatic valves plus timing devices and/or interlocks.

In nitrogen-natural gas, it will be apparent that any of the hydrocarbons referred to above can be used as a substitute for natural gas. This is considered part of the gaseous hydrocarbon which together with the carrier gas provides the carburizing atmosphere described above. The acceptable and preferred ranges of hydrocarbon in the atmosphere are not changed because of the use of the nitrogen-natural gas mixture during the high flow cycle.

Preferred low flow-high flow carrier gas combinations are (i) the use of a constant flow of endo gas at low flow throughout with the additional gas to make up the high flow being nitrogen-methanol and (ii) the use of nitrogen-methanol for both low and high flows.

An advantage of operating subject process with a nitrogen source is that in case of a failure of endo generators through power failure, natural gas interruption, as for another reason, the nitrogen can be used to save the furnace load of steel from surface oxidation. The use of nitrogen-methanol in the carrier gas throughout the process has the additional advantage of reproducibility it lacks being, a disadvantage of endo gas.

Carbonitriding is usually carried out at temperatures in the lower part of the 1200° F. to 2200° F. range mentioned above. About 1300° F. to about 1625° F. is preferred. In this case, anhydrous ammonia or ammonia with a very low water content is used to provide nitrogen to the steel surface. Although the ammonia concentration depends on the size of the furnace, the process temperature, and other process details, an amount of about 1 to about 10 percent by volume, based on the total volume of the carburizing atmosphere, is typically used.

The following examples illustrate the invention:

EXAMPLES 1 TO 20

The examples are carried out in a box type carburizing furnace of conventional design, but smaller scale. The furnace has a main heating zone or chamber and a vestibule. The chamber is about 3 cubic feet in volume. There is a door between the chamber and the vestibule and another door between the vestibule and the outside of the furnace. The chamber contains a muffle made of an alloy of about 76% nickel, 16% chromium, and 6% iron, and the steel (or load) to be carburized is placed in the muffle. A one third horsepower fan, used for atmosphere circulation, gives a flow velocity comparable to that in conventionally sized carburizing furnaces. Electrical heating elements on the bottom and sides are controlled using a thermocouple inside the muffle near the load. Another controller, with thermocouple between the muffle and the heating elements, shuts off the power if the furnace is above a safe temperature.

Atmosphere enters the chamber through a tube along the top of the furnace aimed at the fan. Atmosphere is withdrawn, through a water cooled heat exchanger, by a diaphragm pump for analysis for carbon dioxide and methane by infrared analyzers; for nitrogen, carbon monoxide and methane by gas chromotography; and for moisture by dew cup. The entire sampled stream is recycled to the chamber. The one atmosphere exit is sealed and, therefore, essentially the entire flow passes through the door into the vestibule.

The composition of the atmosphere in the vestibule is essentially the same as that in the chamber, which indicates that the door connecting the chamber and the vestibule is not a barrier to the free flow of atmosphere between the two. All carrier gas and gaseous hydrocarbon (enriching gas) is added directly to the chamber.

The temperature of the load is within 11° F. of the control temperature. The load is approximately 20 pounds of SAE 8620 steel rods of various sizes including a rod one inch in diameter. The one inch rod is machined in stages and the machinings are analyzed for carbon.

Synthetic endo gas is made by adding 0.5 percent water (in a Raschig ring packed saturator at 69 pounds per square inch gauge and about 68° F.) to a mixture of 40 percent nitrogen, 40 percent hydrogen, and 20 percent carbon monoxide, all percentages being by volume based on the total volume of the nitrogen-hydrogen-carbon monoxide mixture; 0.25 percent by volume of carbon dioxide is then added to the gas. The furnace atmosphere is controlled by adding methane with a pressure operated control valve in response to the carbon dioxide concentration and in accordance with the equation $Z_A$ is $\simeq$ to $(K_A/100)(X^2/Y_g)$ as set forth above.

Carburizing time is four hours beginning from the point of time at which the chamber (or operating) temperature is 1700° F. After the four hours the load is removed to the vestibule where it cools for two hours. No quench is used.

The experimental procedure is as follows:

(1) Establish high flow (45 cfh) and allow furnace atmosphere to reach $CO_2$ control (see (3) and (4)).

(2) Load vestibule.

(3) When $CO_2$ returns to 0.33%, load furnace.

(4) When $CO_2$ returns to 0.33%, reduce flow to low flow.

(5) Hold $CO_2$ at 0.2% (examples 1 to 6) or 0.125% (examples 7 to 20) until the control thermocouple reaches 1700° F. (carburizing start).

(6) Control at desired $CO_2$ control point for four hours.

(7) Record natural gas flow, methane concentration and $CO_2$ concentration every hour.

(8) Record gas chromatograph and dewpoint at one hour and four hours after start of carburizing.

(9) Raise flow to high flow and pull load into vestibule.

(10) Hold at high flow in vestibule for two hours and then remove.

Variables and results are shown in Tables I, II, and III "Load" is the period from loading to the beginning of carburizing. "Soak" is the period from the time the thermocouple reaches the operating temperature to the end of carburizing. In the "Description", the low flow carrier gas is above the line and the high flow carrier gas is below the line. Where the high flow carrier gas is preceded by a plus (+) sign, the low flow carrier gas is to be added to the high flow carrier gas to provide the total high flow carrier gas.

Table I

| Example No. | Description | FLOWS (SCFH) Time (hr) | $N_2$,CO,$H_2$ | $CO_2$ | $CH_4$ | $H_2O$ | Methane Demand (cu.ft.) | FURNACE ATMOSPHERE G. C. (Volume %) Time (hr) | I.R.(Vol. %) $CO_2$ | $CH_4$ | CO | Time (hr) | $N_2$ | $CH_4$ | CO | $H_2$ (By difference) | Time (hr) | Water Dew Point ° C | Vol. % |
|---|---|---|---|---|---|---|---|---|---|---|---|---|---|---|---|---|---|---|---|
| 1 | 15 CFH | 0 | 15 | — | .82 | — | Load | 0 | .20 | .6 | | 1 | 34.4 | 2.0 | 20 | 43.6 | 1 | −12 | .24 |
| | $N_2$, CO,$H_2$ | 1 | 15 | — | .79 | — | 1.98 | 1 | .125 | 3.2 | | | | | | | | | |
| | | 2.1 | 15 | — | .49 | — | Soak | 2.1 | .125 | 1.6 | | | | | | | | | |
| | 30 CFH | 3.3 | 15 | — | .32 | — | 1.68 | 3.3 | .125 | 1.6 | | | | | | | | | |
| | $N_2$,CO,$H_2$ on door opening | 4 | 15 | — | .37 | — | | 4 | .125 | 1.6 | | 4 | 34.5 | 1.5 | 20 | 44 | 4 | −11 | .26 |
| 2 | 15 CFH | 0 | 15 | .04 | 1.5 | Sat'd | Load | 0 | .20 | 3.4 | | 1 | 31.8 | 5.2 | 19 | 44 | 1 | −12 | .24 |
| | Endo | 1 | 15 | .04 | 1.7 | at | 5.1 | 1 | .125 | 4.7 | | | | | | | | | |
| | 15 CFH Endo+ | 1.75 | 15 | .04 | 1.2 | 68psig | Soak | 1.75 | .125 | 3.8 | | | | | | | | | |
| | 30 CFH $N_2$, | 3.1 | 15 | .04 | 1.2 | | 4.55 | 3.1 | .125 | 3.5 | | 3 | 32.8 | 3.4 | 20 | 43.8 | | | |
| | MEOH on door opening | 4 | 15 | .04 | 1.1 | | | 4 | .125 | 3.5 | | 4 | 32.8 | 3.6 | 20 | 43.6 | 4 | −10 | .28 |
| 3 | 10 CFH | 0 | 10 | — | .89 | — | Load | 0 | .20 | 2.5 | | 1 | 34 | 2.7 | 19.6 | 43.7 | 1 | −11 | .26 |
| | $N_2$, CO,$H_2$ | 1 | 10 | — | .83 | — | 2.73 | 1 | .125 | 2.8 | | | | | | | | | |
| | | 2.4 | 10 | — | .69 | — | Soak | 2.4 | .125 | 2.5 | | | | | | | | | |
| | 15 CFH Endo+ | 3 | 10 | — | .59 | — | 2.38 | 3 | .125 | 2.5 | | | | | | | | | |
| | 30 CFH $N_2$, MEOH on door opening | 4 | 10 | — | .66 | — | | 4 | .125 | 2.5 | | 4 | 35.6 | 1.9 | 20.6 | 41.9 | 4 | −11 | .26 |
| 4 | 30 CFH | 0 | 30 | .075 | 1.1 | Sat'd | Load | 0 | .20 1.2 | 1 | | 34.9 | 1.7 | 20.7 | 42.7 | 1 | −12 | .24 | |
| | Endo | 1 | 30 | .075 | 1.2 | at | 3.49 | 1 | .125 | 2.1 | | | | | | | | | |
| | 15 CFH Endo+ | 2.3 | 30 | .075 | .88 | 68psig | Soak | 2.3 | .125 | 1.8 | | | | | | | | | |
| | 30 CFH $N_2$, | 3.3 | 30 | .075 | .79 | | 3.05 | 3.3 | .125 | 1.7 | | 3.3 | 34.3 | | 20.5 | 43.5 | | | |
| | MEOH on door opening | 4 | 30 | .075 | .67 | | | 4 | .125 | 1.6 | | 4 | 34 | 1.4 | 20.2 | 44.4 | 4 | −12 | .24 |
| 5 | 10 CFH | 0 | 10 | .025 | 2.29 | Sat'd | Load | 0 | .20 | 5 | | 1 | 34.4 | 4.5 | 18 | 45.1 | 1 | −11 | .26 |
| | Endo | 1 | 10 | .025 | 1.69 | at | 5.79 | 1 | .125 | 4.7 | | | | | | | | | |
| | 15 CFH Endo+ | 2.9 | 10 | .025 | 1.38 | | 4.95 | 2.9 | .125 | 4.3 | | | | | | | | | |
| | 30 CFH $N_2$, MEOH on door opening | 4 | 10 | .025 | 1.38 | | | 4 | .125 | 4.0 | | 4 | 34.3 | 4.2 | 20.1 | 41.4 | | | |
| | | | $N_2$ | MEOH cc/min | | | | | | | | | | | | | | | |
| 6 | 10 CFH | 0 | 4 | 1.58 | 1.77 | | Load | 0 | .20 | 2.4 | | 0 | 34 | 3.4 | 19.6 | 43 | 1 | −11 | .26 |
| | $N_2$-MEOH | 1 | 4 | 1.58 | 1.00 | | 3.20 | 1 | .125 | 2.7 | | 1 | 34.1 | 2.4 | 19.5 | 44.1 | | | |
| | 15 CFH | Endo | 2 | 4 | 1.58 | .71 | | Soak | 2 | .125 | 2.3 | | 2 | 33.2 | 1.6 | 20.3 | 44.9 | | |
| | +30 CFH $N_2$, | 3 | 4 | 1.58 | .60 | | 2.38 | 3 | .125 | 2.0 | | 3 | 34 | 1.9 | 19 | 45.1 | | | |
| | MEOH on door opening | 4 | 4 | 1.58 | .52 | | | 4 | .125 | 2.0 | | 4 | 34 | 1.0 | 19.5 | 45.5 | 4 | −13 | .27 |
| 7 | 30 CFH | 0 | 30 | .075 | 1.63 | Sat'd | Load | 0 | .125 | 2.1 | 20 | | | | | | | | |
| | Endo | 1 | 30 | .075 | 1.37 | at | 4.61 | 1 | .105 | 2.25 | 20 | 1 | 35 | 2.23 | 18.6 | 44.2 | 1 | −13 | .22 |
| | 30 CFH $N_2$-MEOH | 2 | 30 | .075 | 1.14 | 68 | Soak | 2 | .105 | 2.1 | 20 | | | | | | | | |
| | +15 CFH $N_2$, CO, $H_2$ | 3 | 30 | .075 | 1.02 | psig | 3.77 | 3 | .105 | 1.8 | 20 | | | | | | | | |
| | on door opening | 4 | 30 | .075 | 1.01 | | | 4 | .105 | 1.75 | 20 | 4 | | | | | 4 | −12 | .24 |
| 8 | 10 CFH | 0 | 10 | .025 | 2.94 | Sat'd | Load | 0 | .125 | 5.2 | 18.5 | | | | | | | | |
| | Endo | 1 | 10 | .025 | | at | 6.8 | 1 | .105 | 4.3 | 18.5 | 1 | 32.6 | 4.85 | 17.6 | 45.0 | 1 | −12.5 | .23 |

Table I-continued

| Example No. | Description | FLOWS (SCFH) Time (hr) | $N_2$,CO,$H_2$ | $CO_2$ | $CH_4$ | $H_2O$ | Methane Demand (cu.ft.) | FURNACE ATMOSPHERE G. C. (Volume %) Time (hr) | I.R.(Vol. %) $CO_2$ | $CH_4$ | CO | Time (hr) | $N_2$ | $CH_4$ | CO | $H_2$ (By difference) | Time (hr) | Water Dew Point ° C | Vol. % |
|---|---|---|---|---|---|---|---|---|---|---|---|---|---|---|---|---|---|---|---|
| | 30 CFH $N_2$-MEOH | 2 | 10 | .025 | 1.68 | 68 | Soak | 2 | .105 | 3.6 | 18.7 | | | | | | | | |
| | +15 CFH $N_2$, CO,$H_2$ | 3.1 | 10 | .025 | 1.42 | psig | 5.7 | 3.1 | .10 | 3.3 | 19.0 | | | | | | | | |
| | on door opening | 4 | 10 | .025 | | | | 4 | .10 | 3.4 | 19.0 | 4 | | | | | | −13.5 | .21 |
| 9 | 10 CFH | 0 | 10 | | 1.46 | | Load | 0 | .125 | 2.0 | 19.7 | | | | | | | | |
| | $N_2$, CO,$H_2$ | 1 | 10 | | .73 | | 2.8 | 1 | .10 | 1.8 | 19.0 | 1 | 35.4 | 1.6 | 18.4 | 44.6 | 1 | −12 | .24 |
| | 35 CFH $N_2$-MEOH + | | | | | | Soak | | | | | | | | | | | | |
| | 10 CFH $N_2$, CO,$H_2$ | | | | | | 2.2 | | | | | | | | | | | | |
| | on door opening | 4 | 10 | | .63 | | | 4 | .096 | 1.5 | 19.5 | 4 | 34.2 | 1.7 | 18.1 | 46 | 4 | −13 | .22 |
| 10 | 7.5 CFH | 0 | 7.5 | | 2.22 | | Load | 0 | .125 | 5.2 | 18.5 | | | | | | | | |
| | $N_2$, CO,$H_2$ | 1 | 7.5 | | 1.78 | | 6.62 | 1 | .11 | 4.5 | 19.0 | 1 | 33 | 5.3 | 17.0 | 44.7 | 1 | −13.5 | .21 |
| | 37.5 CFH $N_2$-MEOH + | 2 | 7.5 | | 1.65 | | Soak | 2 | .11 | 4.1 | 19.0 | | | | | | | | |
| | 7.5 CFH $N_2$, CO, $H_2$ | 3.25 | 7.5 | | 1.49 | | 5.43 | 3.25 | .10 | 3.9 | 19.2 | | | | | | | | |
| | | 4 | 7.5 | | 1.51 | | | 4 | .10 | 3.7 | 19.2 | | | | | | 4 | −13 | .22 |
| 11 | 10 CFH | 0 | 10 | 1 | 1.25 | | Load | 0 | .125 | 1.8 | 19.0 | 0 | 37.5 | 3.6 | 18.6 | 40.3 | | | |
| | $N_2$, CO,$H_2$ | 1 | 10 | | | | 2.4 | 1 | .098 | 2.0 | 19.5 | 1 | 35.9 | 2.9 | 18.9 | 42.3 | 1 | −13.5 | .21 |
| | 30 CFH $N_2$ + 5 CFH $CH_4$ | 2 | 10 | | .58 | | Soak | 2 | .098 | 2.0 | 19.6 | | | | | | | | |
| | on door opening | 4 | 10 | | .47 | | | 4 | .095 | 1.8 | 20.0 | 4 | 34.6 | 1.5 | 18.1 | 45.8 | 4 | −13.5 | .21 |
| 12 | 7.5 CFH | 0 | 7.5 | .025 | | Sat'd | Load | 0 | .125 | 4.6 | 19.0 | | | | | | | | |
| | Endo | 1 | 7.5 | .025 | | at | 5.41 | 1 | .10 | 4.1 | 19.0 | 1 | 34.1 | 4.3 | 18.1 | 43.5 | 1 | −13 | .22 |
| | 37.5 CFH $N_2$-MEOH + | 2.5 | 7.5 | .025 | | 69psig | Soak | 2.5 | .10 | 3.65 | 19.5 | | | | | | | | |
| | 7.5 CFH Endo | 3.5 | 7.5 | .025 | | | 4.2 | 3.5 | .10 | 3.4 | 19.7 | | | | | | | | |
| | on door opening | 4 | 7.5 | .025 | | | | 4 | .10 | 3.5 | 19.5 | 4 | 34.9 | 4.1 | 18.9 | 42.1 | 4 | −13 | .22 |
| 13 | 10 CFH Endo | 0 | 10 | .025 | 2.1 | | | 0 | .086 | 4.5 | 20 | | | | | | | | |
| | (Continuous | 1 | 10 | .025 | .84 | Sat'd | Load | 1 | .085 | 3 | 20 | 1 | 33.3 | 1.9 | 20.7 | 44.1 | 1 | −13.5 | .21 |
| | furnace) | 2 | 10 | .025 | .59 | at | 3.3 | 2 | .09 | 2.5 | 20.5 | | | | | | | | |
| | +35 CFH $N_2$- | 3 | 10 | .025 | .71 | 69psig | Soak | 3 | .095 | | 20 | | | | | | | | |
| | MEOH on door opening | 4 | 10 | .025 | .63 | | 2.3 | 4 | .095 | 1.7 | 20 | 4 | 33.5 | 1.9 | 20 | 44.6 | 4 | −13.5 | .21 |
| 14 | 10 CFH Endo | 0 | 10 | .025 | 2.0 | | | 0 | .125 | 4.5 | 19.0 | | | | | | | | |
| | +35 CFH $N_2$-MEOH | 1 | 10 | .025 | 1.1 | Sat'd | Load | 1 | .075 | 3.2 | 19.0 | 1 | 34.1 | 3.2 | 18.1 | 44.6 | 1 | −16 | .15 |
| | on door opening | 2 | 10 | .025 | .78 | at | 3.5 | 2 | .075 | 2.2 | 19.3 | | | | | | | | |
| | | 3 | 10 | .025 | .58 | 69psig | Soak | 3 | .075 | 2.0 | 19.5 | | | | | | | | |
| | | 4 | 10 | .025 | .59 | | 2.6 | 4 | .075 | 1.8 | 19.5 | 4 | 33.7 | 1.8 | 18.5 | 46 | 4 | −15.5 | .16 |

Table I-continued

| Example No. | Description | FLOWS (SCFH) Time (hr) | $N_2$,CO,$H_2$ | $CO_2$ | $CH_4$ | $H_2O$ | Methane Demand (cu.ft.) | FURNACE ATMOSPHERE G. C. (Volume %) Time (hr) | I.R.(Vol. %) $CO_2$ | $CH_4$ | CO | Time (hr) | $N_2$ | $CH_4$ | CO | $H_2$ (By difference) | Time (hr) | Water Dew Point ° C | Vol. % |
|---|---|---|---|---|---|---|---|---|---|---|---|---|---|---|---|---|---|---|---|
| 15 | 10 CFH Endo | 0 | 10 | .025 | 1.03 | | | 0 | .125 | 3.2 | 18.5 | | | | | | | | |
| | +35 CFH $N_2$ on door opening | 1 | 10 | .025 | .97 | Sat'd | Load | 1 | .10 | 2.7 | 19.5 | 1 | 34.7 | 2.4 | 18.1 | 44.5 | 1 | −13.5 | .21 |
| | | .19 | 10 | .025 | .57 | at | 2.73 | 1.9 | .10 | 2.1 | 19.7 | | | | | | | | |
| | | 3.1 | 10 | .025 | .61 | 69psig | Soak | 3.1 | .10 | 1.9 | 19.7 | | | | | | | | |
| | | 4 | 10 | .025 | .45 | | 2.22 | 4 | .095 | 1.7 | 20 | 4 | 34.7 | 1.7 | 18.1 | 45.5 | 4 | −13 | .22 |
| 16 | 5 CFH Endo | 0 | 5 | .01 | | Sat'd | | 0 | .125 | 5.3 | 18.5 | | | | | | | | |
| | | 1 | 5 | .01 | 1.22 | at | Soak | 1 | .10 | 4.1 | 19 | 1 | 33.5 | 3.4 | 18 | 45.1 | 1 | −14 | .20 |
| | 40 CFH $N_2$-MEOH on door opening | 2.5 | 5 | 0.1 | 1.20 | 69psig | 4.05 | 2.5 | .10 | 3.7 | 19 | | | | | | | | |
| | | 3.1 | 5 | .01 | 1.10 | | | 3.1 | .097 | 3.5 | 19 | | | | | | | | |
| | | 4.16 | 5 | .01 | 1.03 | | | 4.16 | .095 | 3.2 | 19 | | | | | | | | |
| | | | $N_2$ | MEOH(cc/min.). | | | | | | | | | | | | | | | |
| 17 | 7.5 CFH $N_2$-MEOH | 0 | 3 | 1.19 | 2.21 | | | 0 | .125 | 5.1 | 18.5 | | | | | | | | |
| | | 1 | 3 | 1.19 | 1.23 | | Load | 1 | .10 | 3.6 | 19.4 | 1 | 31.5 | | 19.2 | 45.7 | 1 | −13 | .22 |
| | +37.5 CFH $N_2$-MEOH on door opening | 2 | 3 | 1.19 | .78 | | 3.63 | 2 | .10 | 2.3 | 19.6 | | | | | | | | |
| | | 3 | 3 | 1.19 | .56 | | Soak | 3 | .10 | 2.1 | 19.6 | | | | | | | | |
| | | 4 | 3 | 1.19 | .55 | | 2.57 | 4 | .095 | 1.8 | 19.8 | 4 | 34.7 | 2.5 | 18.9 | 44 | | | |
| | | | $N_2$ | MEOH(cc/min.). | | | | | | | | | | | | | | | |
| 18 | 5 CFH $N_2$-MEOH | 0 | 2 | .795 | 1.37 | | | 0 | .125 | 3.5 | 18.7 | | | | | | | | |
| | | 1 | 2 | .795 | 1.25 | | Load | 1 | .097 | 4.0 | 18.7 | 1 | 33.4 | 4.8 | 18.1 | 43.7 | 1 | −14 | .20 |
| | 40 CFH $N_2$-MEOH on door opening | 2 | 2 | .795 | 1.18 | | 4.83 | 2 | .097 | 4.0 | 19.1 | | | | | | | | |
| | | 3 | 2 | .795 | 1.14 | | Soak | 3 | .097 | 3.7 | 19.3 | | | | | | | | |
| | | 4 | 2 | .795 | 1.04 | | 3.87 | 4 | .097 | 3.5 | 19.5 | 4 | 33.0 | 3.7 | 18.3 | 45 | 4 | −13 | .22 |
| | | | $N_2$, CO,$H_2$ | | | | | | | | | | | | | | | | |
| 19 | 10 CFH Endo | 0 | 10 | .025 | 1.58 | | | 0 | .125 | 1.8 | 19.4 | | | | | | | | |
| | | 1.1 | 10 | .025 | .72 | Sat'd | Load | 1.1 | .097 | 1.4 | 19.5 | 1 | 35.6 | 1.7 | 18.9 | 43.8 | 1 | −12 | .24 |
| | | 2 | 10 | .025 | .45 | at | 2.81 | 2 | .077 | 1.1 | 19.8 | | | | | | | | |
| | | 3 | 10 | .025 | .50 | 69psig | Soak | 3 | .097 | 1.0 | 19.9 | | | | | | | | |
| | | 4 | 10 | .025 | .32 | | 1.92 | 4 | .097 | .8 | 20.0 | 4 | 36.0 | 1.0 | 19.2 | 43.8 | 4 | | |
| 20 | 10 CFH MEOH | | MEOH cc/min | | | | | | | | | | | | | | | | |
| | +35 CFH $N_2$ on door opening | 0 | 2.65 | | 1.62 | | Load | 0 | .33 | 3.7 | >25 | 0 | 9.6 | 4.97 | 24.5 | 61 66 | | | |
| | | 1 | 2.65 | | 1.66 | | 5.67 | 1 | .174 | 4.0 | >25 | 1 | 7.2 | 3.6 | 23 | | | | |
| | | 2 | 2.65 | | 1.18 | | Soak | 2 | .174 | 3.6 | >25 | | | | | | | | |
| | | 3 | 2.65 | | 1.22 | | 4.71 | 3 | .174 | 3.7 | >25 | | | | | | | | |
| | | 4 | 2.65 | | 1.50 | | | 4 | .174 | 4.5 | >25 | | | | | | | | |

Table II

| Example No. | METALLURGICAL RESULTS (carbon concentration) Cut Depth (in.) .0025 | .005 | .010 | .015 | .020 | .025 | .030 | .035 | .040 | Surface Carbon (Wt %) | Case Depth to .4%C (in.) |
|---|---|---|---|---|---|---|---|---|---|---|---|
| 1 | .745 | .741 | .752 | .723 | .644 | .554 | .470 | .405 | .344 | .75 | .034 |
| 2 | .804 | .813 | .776 | .689 | .590 | .509 | .422 | .349 | .351 | .81 | .030 |
| 3 | .771 | .789 | .741 | .663 | .571 | .490 | .487 | .410 | .346 | .80 | .033 |
| 4 | .835 | .853 | .812 | .721 | .627 | .538 | .456 | .381 | .313 | .85 | .031 |
| 5 | .860 | .893 | .844 | .744 | .655 | .558 | .478 | .415 | .351 | .9 | .033 |
| 6 | .812 | .824 | .770 | .683 | .599 | .516 | .432 | .371 | .307 | .81 | .030 |
| 7 | .78 | .80 | .77 | .70 | .61 | .53 | .46 | .38 | .32 | .80 | .0315 |
| 8 | .82 | .83 | .79 | .70 | .61 | .51 | .44 | .37 | .32 | .82 | .031 |
| 9 | .79 | .82 | .76 | .67 | .60 | .52 | .44 | .38 | .33 | .81 | .031 |
| 10 | .86 | .85 | .79 | .70 | .63 | .53 | .46 | .39 | .33 | .86 | .0325 |
| 11 | .88 | .87 | .81 | .73 | .63 | .55 | .47 | .39 | .33 | .88 | .031 |
| 12 | .91 | .92 | .85 | .78 | .68 | .58 | .49 | .42 | .36 | .92 | .034 |
| 13 | .80 | .82 | .77 | .68 | .59 | .52 | .45 | .38 | .34 | .82 | .031 |
| 14 | .93 | .94 | .88 | .79 | .69 | .59 | .50 | .42 | .37 | .94 | .034 |
| 15 | .76 | .80 | .76 | .71 | .59 | .50 | .43 | .37 | .31 | .80 | .030 |
| 16 | .82 | .87 | .81 | .72 | .64 | .55 | .47 | .40 | .33 | .82 | .0325 |
| 17 | .80 | .84 | .79 | .72 | .64 | .55 | .48 | .40 | .34 | .80 | .0325 |
| 18 | .84 | .88 | .83 | .76 | .67 | .58 | .50 | .42 | .36 | .84 | .034 |
| 19 | .63 | .77 | .77 | .69 | .62 | .54 | .45 | .39 | .33 | .63 | .031 |
| 20 | 1.00 | 1.10 | 1.07 | .96 | .85 | .75 | .64 | .54 | .45 | 1.0 | .0395 |

Table III $$Z_A \simeq \left(\frac{K_A}{100}\right)\left(\frac{X^2}{Y_g}\right)$$

$$Z_B \simeq \left(\frac{K_B}{100}\right)\left(\frac{XQ}{Y_g}\right)$$

wherein:

$K_A$ = 0.0175
$K_B$ = 0.025
Y = 0.8 (except in example 14 where Y = 1.0)
g = 0.725

| Example No. | Time (hr.) | $Z_A$ | X | $Z_B$ | Q | Factor = Actual $CO_2$ Concentration / $Z_A$ | Factor = Actual $H_2O$ Concentration / $Z_B$ |
|---|---|---|---|---|---|---|---|
| 1 | 1 | 0.12 | 20 | 0.38 | 44 | | 0.66 |
| | 4 | 0.12 | 20 | 0.38 | 44 | | 0.68 |
| 2 | 1 | 0.11 | 19 | 0.38 | 44 | | 0.63 |
| | 4 | 0.12 | 20 | 0.38 | 44 | | 0.74 |
| 3 | 1 | 0.12 | 20 | 0.37 | 44 | 1.04 | 0.70 |
| | 4 | 0.13 | 21 | 0.38 | 42 | 0.96 | 0.68 |
| 4 | 1 | 0.13 | 21 | 0.39 | 43 | 0.96 | 0.62 |
| | 4 | 0.12 | 20 | 0.38 | 44 | 1.04 | 0.63 |
| 5 | 1 | 0.10 | 18 | 0.35 | 45 | 1.25 | 0.74 |
| | 4 | 0.12 | 20 | 0.35 | 41 | 1.04 | |
| 6 | 1 | 0.115 | 19.5 | 0.37 | 44 | 1.09 | 0.70 |
| | 4 | 0.115 | 19.5 | 0.38 | 45.5 | 1.09 | 0.71 |
| 7 | 1 | 0.12 | 20 | 0.38 | 44 | 0.88 | 0.58 |
| | 4 | 0.12 | 20 | | | 0.88 | |
| 8 | 1 | 0.10 | 18 | 0.35 | 45 | 1.05 | 0.66 |
| | 4 | 0.10 | 19 | | | 1.0 | |
| 9 | 1 | 0.10 | 18 | 0.35 | 45 | 1.0 | 0.69 |
| | 4 | 0.10 | 18 | 0.36 | 46 | 0.96 | 0.61 |
| 10 | 1 | 0.11 | 19 | 0.37 | 45 | 1.0 | 0.57 |
| | 4 | 0.11 | 19 | | | 0.91 | |
| 11 | 1 | 0.11 | 19 | 0.34 | 42 | 1.1 | 0.62 |
| | 4 | 0.10 | 18 | 0.36 | 46 | 1.16 | 0.58 |
| 12 | 1 | 0.10 | 18 | 0.34 | 44 | 1.0 | 0.65 |
| | 4 | 0.11 | 19 | 0.34 | 42 | 1.1 | 0.65 |
| 13 | 1 | 0.13 | 21 | 0.40 | 44 | 0.65 | 0.53 |
| | 4 | 0.12 | 20 | 0.39 | 45 | 0.80 | 0.54 |
| 14 | 1 | .08 | 18 | 0.28 | 45 | 0.94 | 0.54 |
| | 4 | .09 | 19 | 0.30 | 46 | 0.83 | 0.53 |
| 15 | 1 | 0.10 | 18 | 0.35 | 45 | 1.0 | 0.60 |
| | 4 | 0.10 | 18 | 0.36 | 46 | 0.95 | 0.61 |
| 16 | 1 | 0.10 | 18 | 0.35 | 45 | 1.0 | 0.57 |
| | 4 | | | | | 0.91 | .58 |
| 17 | 1 | 0.11 | 19 | 0.38 | 46 | 0.91 | 0.58 |
| | 4 | 0.11 | 19 | 0.36 | 44 | 0.86 | |
| 18 | 1 | 0.10 | 18 | 0.34 | 44 | 0.96 | 0.59 |
| | 4 | 0.10 | 18 | 0.35 | 45 | 0.88 | 0.63 |
| 19 | 1 | 0.11 | 19 | 0.36 | 44 | 0.88 | 0.67 |
| | 4 | 0.11 | 19 | 0.36 | 44 | 0.88 | |
| 20 | 0 | 0.19 | 25 | 0.66 | 61 | 0.89 | |
| | 1 | 0.16 | 23 | 0.65 | 66 | 1.04 | |

Explanatory notes for Tables I, II, and III: SCHF = standard cubic feet per hour hr = hour
cu.ft. = cubic feet
I.R. = infrared analysis
vol. % = percent by volume based on the total volume of $N_2$, CO, and $H_2$
G.C. = gas chromatographic analysis
CFH = cubic feet per hour
MEOH = methanol
Endo = synthetic endo described above
Sat'd = saturated
psig = pounds per square inch guage
cc/min = cubic centimeters per minute
Flows = flow rates
Wt % = percent by weight based on the total weight of the steel
in. = inch or inches
$Z_A$ = percent by volume of carbon dioxide
$Z_B$ = percent by volume of water vapor
$K_A$ = the equilibrium constant for the reaction $2\ CO \rightleftarrows C + CO_2$
X = the percent by volume of carbon dioxide
Y = a predetermined percent by weight of carbon on the surface of the steel based on the weight of the steel
g = the activity coefficient for carbon dissolved in the steel
$K_B$ = the equilibrium constant for the reaction $CO + H_2 \rightleftarrows C + H_2O$
Q = the percent by volume of hydrogen
Factor = correction factor referred to above as represented by the term "about".

Examples 4 and ~ simulate conventional high flow processes. In example 19, the steel is completely blued, and the low surface carbon indicated decarburization. Example 13 is a simulation of a continuous process as would be carried out in a pusher type furnace. The outer door is opened for one minute twice in each hour. High flow rates are used for 5 minutes during and after each of the door openings in all examples except 4, 7, and 19.

I claim:

1. In a process for carburizing steel in a furnace having at least one carburizing chamber, said chamber being closed except for at least one passage through which the steel passes into and out of the chamber and having means for opening and closing the passage, said process comprising the following steps:

(a) opening the passage;
(b) introducing the steel through the passage into the chamber;
(c) closing the passage;
(d) introducing a carrier gas and a gaseous hydrocarbon into the chamber to provide a carburizing atmosphere, said carrier gas being introduced at a high flow rate when the passage is open and at a low flow rate when the passage is closed with the minimum high flow rate being sufficient to essentially prevent oxidation and decarburizing of the steel, and said atmosphere comprising:

| component of atmosphere | percent by volume |
|---|---|
| carbon monoxide | about 4 to about 30 |
| hydrogen | about 10 to about 60 |
| nitrogen | about 10 to about 85 |
| carbon dioxide | 0 to about 4 |
| water vapor | 0 to about 5 |

-continued

| component of atmosphere | percent by volume |
|---|---|
| hydrocarbon | about 1 to about 10, |

said percent by volume being based on the total volume of the atmosphere;

(e) exposing the steel to the carburizing atmosphere at a temperature in the range of about 1200° F. to about 2200° F. until the steel is carburized;
(f) opening the passage;
(g) withdrawing the steel through the passage; and
(h) closing the passage, the improvement comprising:
(i) providing hydrocarbon in an amount sufficient to maintain
$Z_A$ at a level about equal to $(K_A/100)\ (X^2/Y_g)$ wherein:
$Z_A$ is the percent by volume of carbon dioxide;
X is the percent by volume of carbon monoxide;
$K_A$ is the equilibrium constant for the reaction $2\ CO \rightleftarrows C + CO_2$;
Y is a predetermined percent by weight of carbon that is to be present on the surface of the steel, based on the weight of the steel; and
g is the activity coefficient for carbon dissolved in the steel;
(ii) providing a minimum low flow rate of carrier gas sufficient to limit the oxygen species entering the atmosphere whereby an amount of no greater than about 10 percent hydrocarbon, as a component of atmosphere, will be required to maintain the value of $Z_A$ as set forth above; and
(iii) providing a maximum low flow rate of carrier gas no greater than about one half of the minimum high flow rate of the carrier gas.

2. The process defined in claim 1 wherein the carrier gas is endo gas, nitrogen and methanol, or nitrogen and ethanol.

3. The process defined in claim 1 wherein the atmosphere contains ammonia in an amount of about 1 to about 10 percent by volume.

4. The process defined in claim 2 wherein the atmosphere comprises:

| component of atmosphere | percent by volume |
|---|---|
| carbon monoxide | about 18 to about 23 |
| hydrogen | about 27 to about 45 |
| nitrogen | about 34 to about 47 |
| carbon dioxide | 0 to about 1 |
| water vapor | 0 to about 2 |
| hydrocarbon | about 1 to about 8, |

and, with respect to (ii), the amount of hydrocarbon is no greater than about 8 percent.

5. The process defined in claim 2 wherein the carrier gas is nitrogen and methanol.

6. The process defined in claim 1 wherein the gaseous hydrocarbon is a $C_1$ to $C_5$ hydrocarbon or mixtures thereof.

7. The proces defined in claim 6 wherein the gaseous hydrocarbon is methane or propane.

8. The process defined in claim 4 wherein the gaseous hydrocarbon is methane.

9. The process defined in claim 8 wherein the source of the methane is natural gas.

10. The process defined in claim 1 wherein the temperature is in the range of about 1500° F. to about 1850° F.

11. The process defined in claim 8 wherein the temperature is in the range of about 1500° F. to about 1850° F.

* * * * *